United States Patent [19]

Wennerbo et al.

[11] Patent Number: 5,005,467

[45] Date of Patent: Apr. 9, 1991

[54] PILOT-OPERATED FLOW CONTROLLING DIRECTIONAL CONTROL VALVE WITH COPYING SPOOL

[75] Inventors: Orjan E. V. Wennerbo; Bo Nilstam, both cf Boras, Sweden

[73] Assignee: Atlas Copco Aktiebolag, Nacka, Sweden

[21] Appl. No.: 195,119

[22] Filed: May 17, 1988

[30] Foreign Application Priority Data

May 18, 1987 [SE] Sweden ..... 8702019

[51] Int. Cl.[5] ..... F15B 13/042

[52] U.S. Cl. ..... 91/461; 137/596.13

[58] Field of Search ..... 91/461, 420, 518; 60/422, 459, 462, 393, 421; 137/596.13, 596.14, 596.15, 596, 625.68, 625.62, 625.6, 625.61

[56] References Cited

U.S. PATENT DOCUMENTS

| | | | |
|---|---|---|---|
| 3,200,845 | 8/1965 | Nakazima et al. | 137/625.6 X |
| 3,304,953 | 2/1967 | Wickline et al. | 137/625.6 X |
| 3,799,200 | 3/1974 | Tipton | 91/461 X |
| 3,910,311 | 10/1975 | Wilke | 137/596.13 X |
| 4,006,663 | 2/1977 | Baatrup et al. | 91/420 X |
| 4,245,671 | 1/1981 | Kosugui | 137/625.6 X |
| 4,282,898 | 8/1981 | Harmon | 137/596.13 |
| 4,303,003 | 12/1981 | Reip | 137/625.68 X |
| 4,509,406 | 4/1985 | Melocik | 91/461 X |
| 4,633,762 | 1/1987 | Tardy | 91/461 |
| 4,724,673 | 2/1988 | Curnow | 91/461 X |
| 4,753,157 | 6/1988 | Lonnemo et al. | 91/461 X |

FOREIGN PATENT DOCUMENTS

| | | | |
|---|---|---|---|
| 0066717 | 12/1982 | European Pat. Off. . | |
| 2460348 | 6/1976 | Fed. Rep. of Germany | 91/461 |
| 3041339 | 6/1982 | Fed. Rep. of Germany | 137/625.61 |
| 56-59007 | 5/1981 | Japan | 137/596.14 |
| 56-59008 | 5/1981 | Japan | 137/596.14 |
| 1214713 | 12/1970 | United Kingdom | 137/625.6 |

*Primary Examiner*—Edward K. Look
*Assistant Examiner*—George Kapsalas
*Attorney, Agent, or Firm*—Frishauf, Holtz, Goodman & Woodward

[57] ABSTRACT

Device in a hydraulic power system connected to a load driving hydraulic motor (18; 32), comprising a pilot controlled flow regulating directional valve (1; 29) for alternative connection of the service ports of the motor (18; 32) to a pressure medium source and a tank. The directional valve (1; 29) comprises two opposite and by a pilot pressure activatable activating means (3, 4), and a pilot pressure means (84) is arranged to pressurize and activate the activating means (3, 4), alternatively, and drain one of the activating means to the tank through a flow restriction (5, 7) at activation of the other activating means (3, 4). The power system comprises at least one control flow circuit (10–12; 72–83; 37–44) which communicates with one of the activating means (3, 4), and a valve means (11, 12; 71; 31) which is arranged to accomplish a flow through the control flow circuit (10–12; 72–83; 37–44) in relation to the load pressure on the motor such that the counter pressure from the flow restriction (5, 7) generates a compensating force in relation to the load pressure on the motor on the non-activated activating means (3, 4).

8 Claims, 3 Drawing Sheets

PILOT-OPERATED FLOW CONTROLLING DIRECTIONAL CONTROL VALVE WITH COPYING SPOOL

BACKGROUND OF THE INVENTION

This invention relates to hydraulic valves of the type which are intended to direct a hydraulic fluid as well as control the size of a flow to a flow consuming device comprising load objects in the form of hydraulic actuators and/or other types of hydraulic motors.

The above mentioned hydraulic valves may be of the two main types: open centre valve or closed centre valve.

The former type of valve is intended to work in combination with a hydraulic pump having constant displacement and being arranged to let the entire pump flow pass through the valve unrestrictedly as the valve occupies its neutral or inactivated position. As the valve is activated the desired flow is directed to the load object, usually by bypass control.

The latter type of valve is intended to work in combination with a variable displacement pump and an automatically operating shunt. When inactivated, the directional valve itself is closed as regards the pump flow. The actual type of valve is used either in a system with constant pump pressure, then it is called constant pressure valve, or in a system in which the pump pressure corresponds to the heaviest load in each moment. Then the valve is referred to as load sensing. The invention is mainly related to the last type of valve, also called LS valve, but to some extent it is related to constant pressure valves and constant flow valves.

Accelerations of inertial loads at for instance the slew function in an excavator, result in increases in the load pressure which are proportional to the magnitude of the acceleration. If the acceleration is fast enough toward a desired speed, the result usually is that when the desired speed is reached the hydraulic motor suddenly operates as a pump driven by the inertial load. The continuous condition is disturbed in that the motor momentarily consumes more fluid than what is delivered from the pump.

Accordingly, there will be a shortage of fluid resulting in the pressure falling towards zero.

Consequently, the inertial load is retarded, and in the next sequence the load is re-accelerated by the pump flow, which results in a pressure increase. Due to this and to the elasticity inherent in the system, the result is an oscillation of a low frequency and rather a big amplitude which influences negatively the controllability and makes precision movements more difficult. This problem is most significant at LS valves which have a poor internal damping. At slow accelerations, there are mostly aperiodic oscillations, and the abovementioned problems do not occur.

One way of improving this condition is to adapt the valve spool restrictions as regards the flow to and from the motor such that a certain pressure above the load pressure is maintained. By this arrangement it is possible to improve the stiffness of the motor, and, thereby reduce the oscillations. Another way of doing this is to install a double overcenter valve at the main connections of the motor. Then, the motor can not "run ahead" of the flow and cause large pressure variations in the system. Unfortunately, it is not possible to have such a valve function to operate completely satisfactorily without causing large pressure drop losses in the power circuit as well as damping on the activation side. More effective methods may be used though, methods that can be used with less losses and a safer operation.

In the European Patent Publication No. EP 0066717 there is shown a solution to the problem of how to start and stop softly heavy inertial loads. The motor pressure is arranged to act upon auxiliary pistons located in the inlet part of the valve spool and which counteract the activation signal. Thereby, the valve spool displacement is counteracted and a damping action is obtained. The return force acting on the spool acts in the same instant the pressure distortion occurs, which means that the latter is damped without any phase shift.

Another solution to the problem and which gives a softer damping than the above mentioned is described below.

DETAILED DESCRIPTION OF THE PREFERRED EMBODIMENTS

Figure 1:
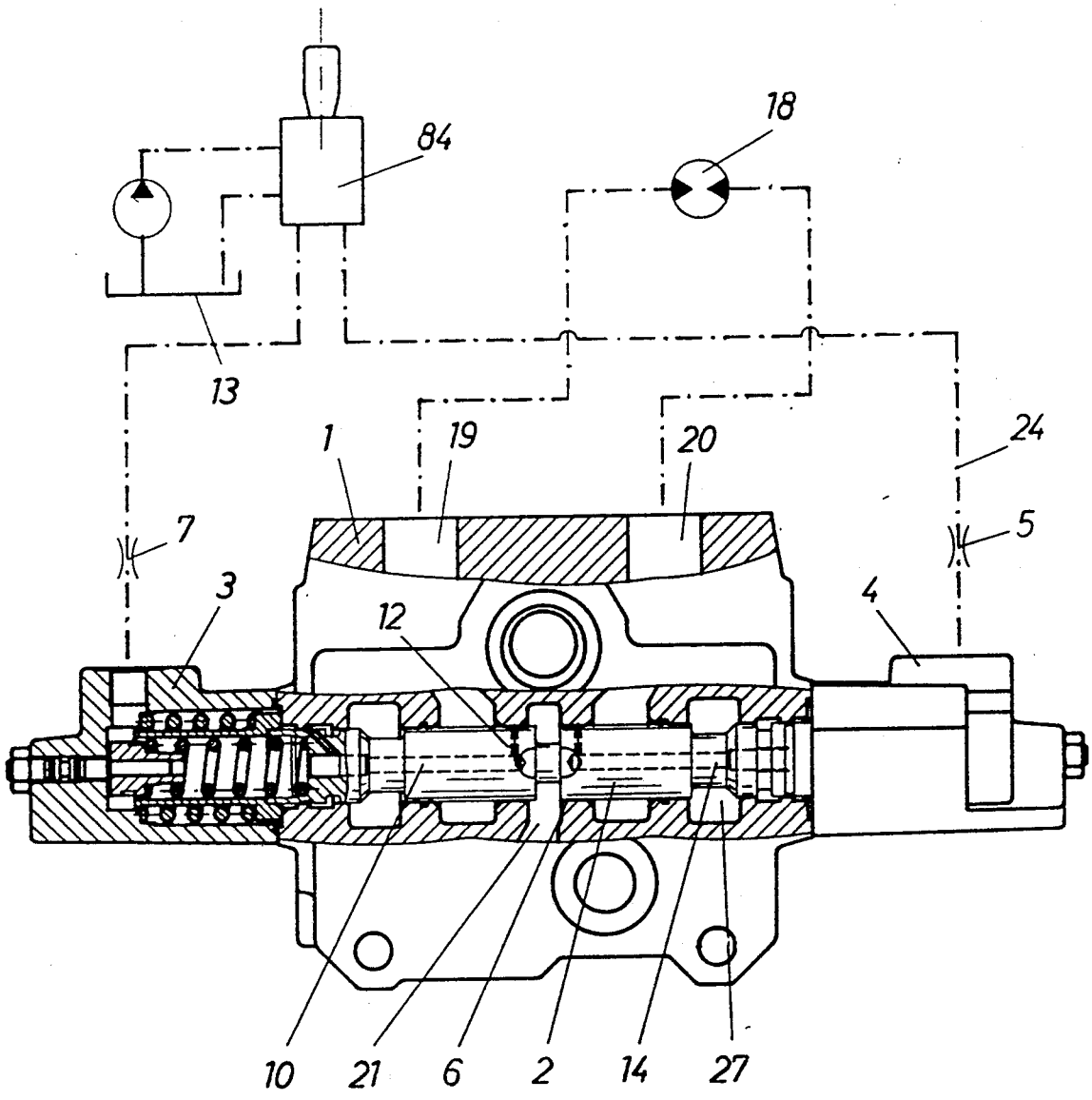
FIG. 1 shows a hydraulic power system provided with a device according to the invention.

The directional valve shown in FIG. 1 comprises a valve housing 1 and a main valve spool 2 which is displaceable in a bore 6 in the valve housing 1 and which is axially pretensioned between sping packs in the two opposite activation means 3 and 4. If a hydraulic activation pressure from the pilot valve 84 is applied to one of the two activation means 3 and 4, the valve spool 2 is moved proportionally to the activation pressure provided the activation pressure is higher than the threshold value for accomplishing any movement at all. The influence of the flow generated forces on the valve spool position are not considered.

The load object 18 is connected to the service ports 19 and 20, and the port 21 is connected to a pressure fluid source, i.e. the hydraulic pump.

The valve spool 2 is provided with an axial bore 10 extending from the left end of the valve spool to the central groove thereof. The bore 10 is closed by means of a plug 22. At this plug, a slanted bore 15 extends between a groove 11 on the circumference of valve spool and the bore 10, and at the other end of the bore 10 there is a small radial restriction opening 12. The bores 10, 15, the opening 12, and the groove 11 form a control flow passage. As the valve spool 2 occupies its neutral position the opening 12 is closed by the inner surface of the bore 6. So is the groove 11. What has been said about the left part of the valve spool 2 is also relevant for the right part thereof. In the shown example, the valve spool 2 is symmetrical.

Suppose that an activation pressure is applied on the right hand activation means 4 via the conduit 24 such that the valve spool 2 is moved to the left and that the groove 26 is first opened by the corresponding edge of the valve spool. Thereby communication is established between the load pressure in the service port 19 and a sensing passage which communicates with the LS-regulator of the pump. Then, the pump will increase the system pressure at the inlet port 21, which pressure corresponds to the load pressure at the service port 19 plus an additional pressure for regulation. Immediately thereafter, connection is established between the ports 21 and 19, whereby a supply flow is obtained to the motor 18. The size of the supply flow is determined by the displacement of the spool 2. The return flow passes through the port 20 and the groove 14 of the valve spool 2 back to the hydraulic tank 13 via passage 27.

As the slide 2 is displaced to the left, the opening 12 is uncovered such that a restricted load pressure may propagate to the bores 10 and 15 as well as to the groove 11 which is uncovered by the edge 23 in the bore 6. A control or return flow is supplied to the activating means 3. The size of the control flow is determined by the load pressure on the motor. The control flow is returned through the restriction 7 back to the pilot pressure means 84 where it is drained to the tank 13. The restrictions 5 and 7 are not absolutely necessary for the operation but ought to be comprised in the system so as to amplify the result and make it possible to choose a suitable degree of compensation movement of the valve spool.

Due to the restriction 7 and the flow restriction in the pilot pressure means 84 a control pressure is built up in the activating means 3 counteracting the control pressure applied at the activating means 4. Hereby, there is obtained a momentary damping of the flow increase at acceleration which is very important when handling inertial loads supported by elastic structures where oscillation easily occurs. This solution also means, however, that under static conditions there is accomplished a certain deviation in the displacement of the valve related to the size of the load. For a slew function it means though that this statical influence results in a softer retardation of the movement, which is favourable.

The operation has been discussed for the case a control pressure is applied on the activating means 4. Due to the symmetrical design of the device, an identical effect is obtained as a control pressure is applied on the activating means 3.

Figure 2:
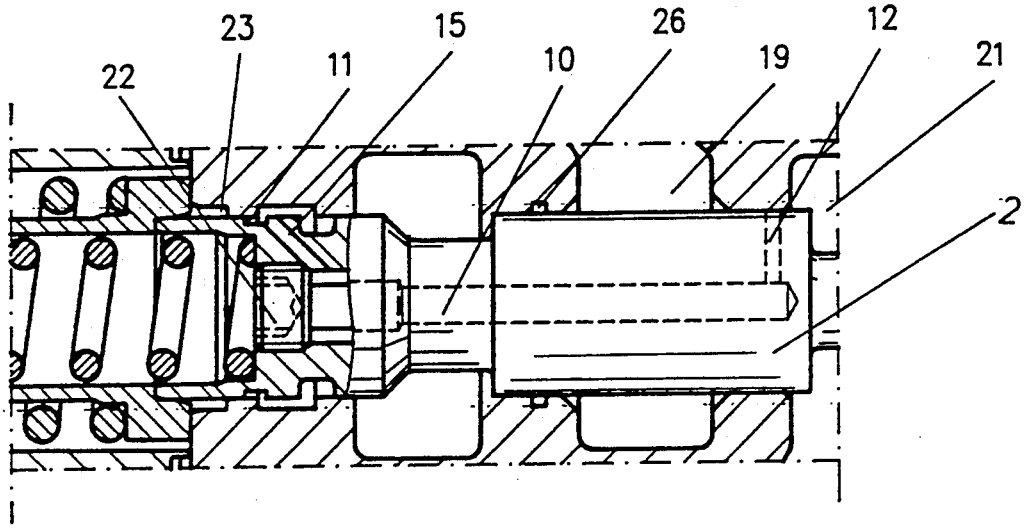
FIG. 2 shows, on a larger scale, a fraction of the device according to FIG. 1.

Oscillating problems not only occur in connection with inertial loads although the problem is more significant in such cases. Also when gravitation loads are to be handled, for instance when operating the digging arm of an excavator, oscillations may occur during lifting sequence. Of course, the solution according to the basic idea of this invention, as illustrated in FIG. 1 and FIG. 2, may be used to mitigate the oscillation tendency. However, this solution involves some shortcoming in the last mentioned application, namely as regards lifting. If you wish to lift at a very low speed it may occur that the flow from the inlet port 21 to the service port 19 becomes smaller than the compensation flow through the control passage 12, 10 and 15. The probability for this to happen increases with the size of the load to be lifted. The result is that the load will sink inspite of the valve being operated to accomplish a lifting movement. This is of course not desirable.

Figure 3:
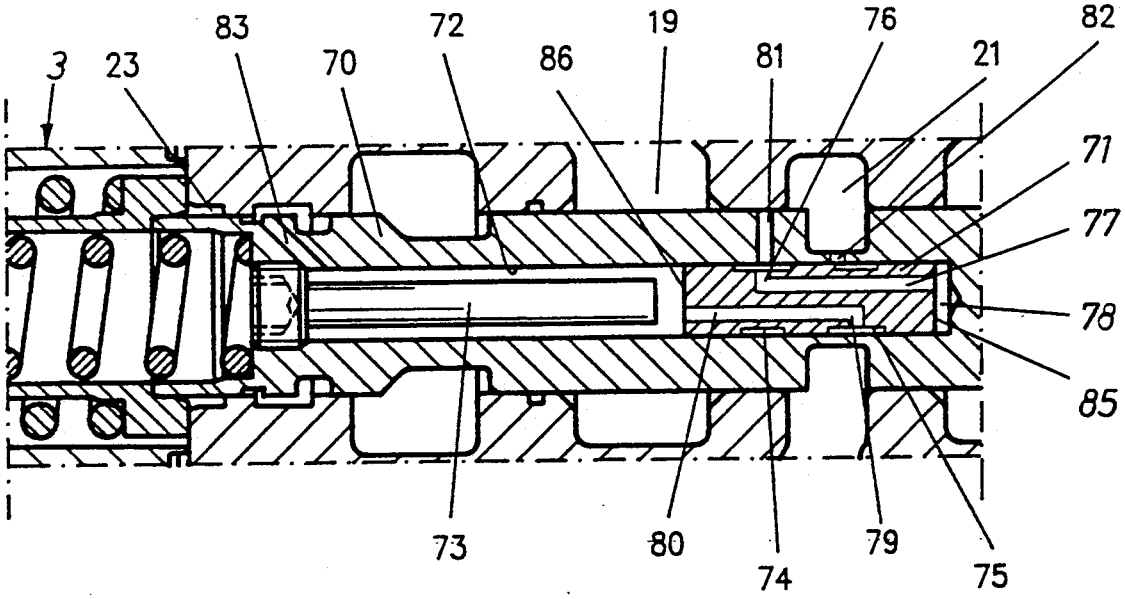
FIG. 3 shows, on a larger scale, a fraction of a device according to an alternative embodiment of the invention.

This problem could be solved though in that the valve spool 10 shown in FIGS. 1 and 2 is replaced by a spool 70 shown in FIG. 3. The spool 70 is provided with a so called copying valve, comprising a spool 71 which is axially displaceable in a coaxial bore 72 in the main spool 70. The displacement of spool 71 is limited by the bottom wall of the bore 72 and by a distance plug 73.

The copying spool 71 is formed with circumferential grooves 74 and 75. The groove 74 communicates with a chamber 78 at the bottom of bore 72 via an opening 76 and an axial bore 77. The groove 75 communicates with the bore 72 via an opening 79 and an axial bore 80. The bore 72 forms a chamber.

The copying spool 71 distributes hydraulic oil through the main spool 70 and the radial openings 81 and 82 in the latter. The opening 81 has the same purpose as the opening 12 in the embodiment shown in FIG. 2, which means that when the spool 70 is moved to the left and communication is established between the openings 21 and 19 the opening 81 is uncovered to let through load pressure oil. This oil is not passed on directly through the opening 83 to form a compensation flow as in the previous embodiment. Instead, the pressure at the opening 81 propagates through the openings 76 and 77 to the chamber 78 where the copying spool 71 is acted upon by a force directed to the left. This force moves the spool 71 to the left, whereby the opening 82 is uncovered to establish a flow at pump pressure. This flow passes on through the passage 75, 79 and 80 to the chamber in the bore 72 where an intermediate pressure is built up for balancing the left hand directed force on the copying spool 71. The position of the latter will be adapted such that the compensating flow from the pump passage through the opening 82 will be large enough to cause a pressure drop across 83 and 7 which will correspond to the pressure in the service port 19.

From the above discussion, it is evident that no oil will be consumed from the service port 19, just a tiny amount which will be necessary to displace the copying spool 71. So, at a slow lifting movement the load can not sink, because the compensating flow is brought directly from the pump. When the main spool 70 is brought back to its neutral position, the spool 71 is moved to the right and the opening 82 is closed.

In FIG. 3, there is shown a one-sided application of a copying spool in the main slide, but if possible from the geometric point of view, the main spool may be provided with two copying spools—one for each movement direction of the main spool.

Figure 4:
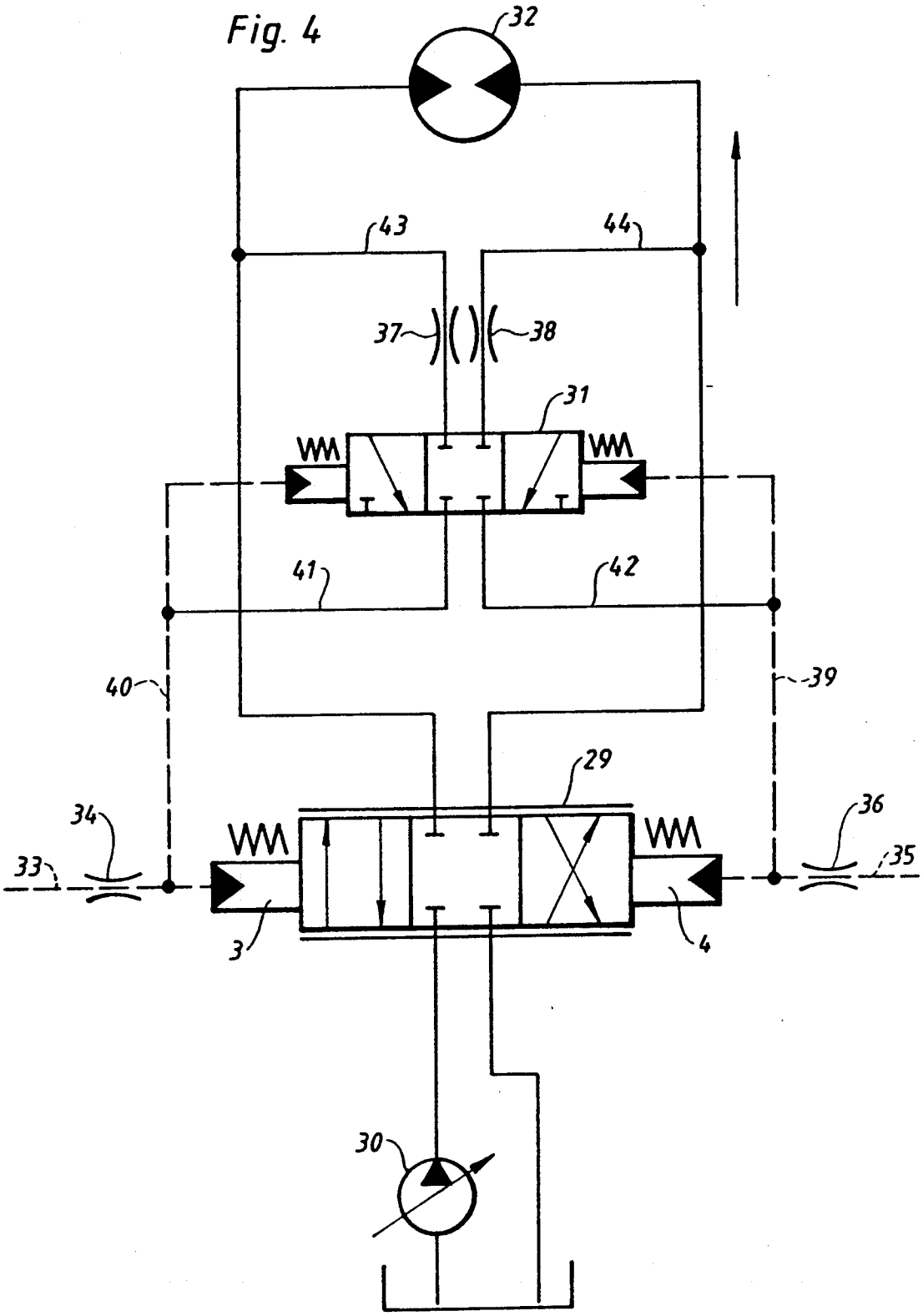
FIG. 4 shows schematically still another embodiment of the invention.

Instead of arranging valve functions within the main valve spool itself, it is possible to provide an external auxiliary valve. See FIG. 4.

The system shown in this figure comprises a main valve 29, an auxiliary valve 31, a load object 32 and a pump 30.

The auxiliary valve 31 is operated in parallel with a main valve, with a certain amount phase lead for the auxiliary valve and with a hydraulic control pressure applied through conduits 33 and 35, alternatively.

When for example a control pressure is applied through the conduit 35 the right hand side activating means of the main valve 29 and the auxiliary valve 31 are activated. This results in a flow from the pump 30 to the load object 32, see arrow. This flow will accelerate the load object while a load pressure corresponding thereto is established. The conduit 44 is connected with the conduit 41 through the restriction 38. The size of the restriction 38 is chosen in consideration of the compensating flow to be generated by the load pressure and which shall reach the left hand compensating pressure connection. The compensating flow, however, passes through the restriction 34 before reaching the conduit 33 and the further on to the tank. Owing to the pressure drop across the restriction 34 and the pressure drop which is generated in the compensating pressure valve, there is developed a counter directed control pressure related to the load pressure, a control pressure which will reduce the displacement of the valve and contribute to the damping of the oscillations. The system is completely symmetrical, which means that if a control pressure is applied at the connection 33 there is obtained an identical result. As in the previous solutions, there is obtained a static deviation between the control pressure and the main flow which is related to the size of the load.

The valve 31 may as well be an electrically controlled auxiliary valve with corresponding action. The essential thing is that the valve is opened before the main valve.

We claim:

1. A hydraulic power system connected to and controlling a load driving hydraulic motor (18; 32) apparatus, comprising:

a pilot operated flow controlling directional valve means (1; 29) comprising: a fluid inlet port (21); two alternatively pressurized service ports (19, 20) for alternatively connecting communication ports of the load driving hydraulic motor (18; 32) to a pressure medium source and a tank; two oppositely located and pilot pressure activated activating means (3, 4); and a pilot pressure means (84) for pressurizing and activating one at a time of said activating means (3, 4) while draining the other one of said activating means (3, 4) to the tank through a flow restriction (5, 7);

at least one control flow circuit means (10–12; 72–83; 37–44) for communicating with one of said activating means (3, 4); and load pressure responsive compensating means including a control valve means (11, 12; 71; 31) for accomplishing a flow through said at least one control flow circuit means (10–12; 72–83; 37–44) in relation to the load pressure of the motor, for causing a counter pressure from said flow restriction (5, 7) to be built up in the non-activated activating means for thereby generating a compensating force, which is related to the load pressure on the motor, on the non-activated activating means, said built up counter pressure being proportional to the load pressure but not proportional to the pilot pressure;

said control valve means comprising: a continuously variable copying valve (71–81) which has a first surface (85) for pressure loading the copying valve in one direction and a second surface (86) for pressure loading the copying valve in an opposite direction; and a first passage means (76, 77) for connecting said first surface (85) with one of said pressurized service ports (19, 20) of said directional valve means (1) and a second passage means (79, 80) for connecting said second surface (86) with said fluid inlet port (21) of said directional valve means (1), said second surface (86) also communicating with said non-activated activating means (3) via said at least one control flow circuit means, whereby said copying valve provides a continuously variable control flow which is proportional to the load pressure on the motor from said pressure fluid inlet port (21) to said non-activated activating means (3).

2. The apparatus of claim 1, wherein said directional valve means (1) comprises two control flow circuits each connected to one of said activating means (3, 4) of said directional valve means (1) so as to accomplish alternative compensating forces in the directions of said directional valve means (1).

3. The apparatus of claim 1, wherein:

said directional valve means comprises a spool (70) having a coaxial bore (72) therein;

said copying valve comprises a valve element (71) axially displaceable in said bore (72), said valve element (71) having pressure load surfaces (85, 86);

said directional valve spool (70) comprises radial openings (81, 82) extending between the outside of said directional valve spool (70) and said bore (72);

said valve element (71) has a circumferential groove (74, 75) formed thereon; and said valve element (71) has an L-formed passage means (76/77, 79/80) formed therein for connecting said circumferential groove (74, 75) with one of the pressure load surfaces (85, 86) of the valve element (71).

4. The apparatus of claim 1, wherein said flow restriction (5, 7) is located between each of said activating means (3, 4) and said pilot pressure means (84).

5. The apparatus of claim 4, wherein said control valve means is arranged to communicate with at least one of said service ports (19, 20) for accomplishing said flow.

6. A hydraulic power system connected to and controlling a load driving hydraulic motor (18; 32) apparatus, comprising:

a pilot operated flow controlling directional valve means (1; 29) for alternatively connecting communication ports of the load driving hydraulic motor (18; 32) to a pressure medium source and a tank, said directional valve means (1; 29) comprising two oppositely located and pilot pressure activated activating means (3, 4), and a pilot pressure means (84) for pressurizing and activating said activating means (3, 4) to drain one of said activating means (3, 4) to the tank through a flow restriction (5, 7) at activation of the other of said activating means;

at least one control flow circuit means (10–12; 72–83; 37–44) for communicating with one of said activating means (3, 4);

control valve means (11, 12; 71; 31) for accomplishing a flow through said at least one control flow circuit means (10–12; 72–83; 37–44) in relation to the load pressure of the motor, causing a counter pressure from said flow restriction (5, 7) to be built up in the non-activated activating means for thereby generating a compensating force on the non-activated activating means, which compensating force is related to the load pressure on the motor;

said directional valve means has two alternatively pressurized service ports (19, 20) and a fluid inlet port (21); and said control valve means comprises a continuously variable copying valve (71–81) which has a first surface (85) for pressure loading the copying valve in one direction and a second surface (86) for pressure loading the copying valve in an opposite direction, and a first passage means (76, 77) for connecting said first surface (85) with one of said pressurized service ports (19, 20) of said directional valve means (1) and a second passage means (79, 80) for connecting said second surface (86) with said fluid inlet port (21) of said directional valve means (1), said second surface (86) also communicating with said non-activated activating means (3) via said at least one control flow circuit means, whereby said copying valve provides a continuously variable control flow which is proportional to the load pressure on the motor from said pressure fluid inlet port (21) to said non-activated activating means (3).

7. The apparatus of claim 6, wherein said directional valve means (1) comprises two control flow circuits each connected to one of said activating means (3, 4) of said directional valve means (1) so as to accomplish alternative compensating forces in the directions of said directional valve means (1).

8. The apparatus of claim 6, wherein:

said directional valve means comprises a spool (70) having a coaxial bore (72) therein;

said copying valve comprises a valve element (71) axially displaceable in said bore (72), said valve element (71) having pressure load surfaces (85, 86);

said directional valve spool (70) comprises radial openings (81, 82) extending between the outside of said directional valve spool (70) and said bore (72);

said valve element (71) has a circumferential groove (74, 75) formed thereon; and said valve element (71) has an L-formed passage means (76/77, 79/80) formed therein for connecting said circumferential groove (74, 75) with one of the pressure load surfaces (85, 86) of the valve element (71).

* * * * *